US010792215B2

(12) United States Patent
Nilsson et al.

(10) Patent No.: US 10,792,215 B2
(45) **Date of Patent: *Oct. 6, 2020**

(54) MECHANICAL CPR DEVICE

(71) Applicant: Physio-Control, Inc., Redmond, WA (US)

(72) Inventors: Lars Anders Nilsson, Åkarp (SE); Bjarne Madsen Härdig, Lund (SE)

(73) Assignee: PHYSIO-CONTROL, INC., Redmond, WA (US)

( * ) Notice: Subject to any disclaimer, the term of this patent is extended or adjusted under 35 U.S.C. 154(b) by 667 days.

This patent is subject to a terminal disclaimer.

(21) Appl. No.: 15/648,410

(22) Filed: Jul. 12, 2017

(65) Prior Publication Data

US 2017/0304146 A1 Oct. 26, 2017

Related U.S. Application Data

(63) Continuation of application No. 14/137,721, filed on Dec. 20, 2013, now Pat. No. 9,713,568.
(Continued)

(51) Int. Cl.
*A61H 31/00* (2006.01)

(52) U.S. Cl.
CPC ..... *A61H 31/006* (2013.01); *A61H 31/005* (2013.01); *A61H 2031/001* (2013.01);
(Continued)

(58) Field of Classification Search
CPC .... A61H 31/00; A61H 31/004; A61H 31/006; A61H 31/008; A61H 2031/001;
(Continued)

(56) References Cited

U.S. PATENT DOCUMENTS 219,428 A 9/1879 Armstead
517,481 A 4/1894 Pressey
(Continued)

FOREIGN PATENT DOCUMENTS

CH 256694 A 8/1948
DE 468358 C 11/1928
(Continued)

OTHER PUBLICATIONS

Krieger, Lisa M. "Toilet Plunger Successful in CPR, Son Saves Dad's Life After Heart Attack by "Plunging" Chest"; The San Francisco Examiner, Oct. 2 1990; 2 pages.
(Continued)

*Primary Examiner* — Michael J Tsai
(74) *Attorney, Agent, or Firm* — Miller Nash Graham and Dunn

(57) ABSTRACT

A mechanism attached to a mechanical CPR device can be automatically attached to the patient's torso. The mechanical CPR device can extend the mechanism to a first position at which the mechanism comes into contact with the patient's torso. The mechanism can be further extended until a first threshold is reached. The mechanism can be retracted to the first position. The mechanism can be further retracted from the first position until a second threshold is exceeded. The mechanism can then be extended to a second point at which the second threshold is no longer exceeded. The mechanism may comprise a suction cup or sticker plate, and may be attached to an end of a piston of the mechanical CPR device.

24 Claims, 12 Drawing Sheets

Related U.S. Application Data

(60) Provisional application No. 61/745,256, filed on Dec. 21, 2012, provisional application No. 61/745,279, filed on Dec. 21, 2012.

(52) U.S. Cl.
CPC ..... *A61H 2201/1246* (2013.01); *A61H 2201/5007* (2013.01); *A61H 2201/5061* (2013.01); *A61H 2201/5064* (2013.01)

(58) Field of Classification Search
CPC ..... A61H 2031/002; A61H 2031/003; A61H 2201/0176; A61H 2201/018; A61H 2201/123; A61H 2201/5064; A61H 2201/5066
See application file for complete search history.

(56) References Cited

U.S. PATENT DOCUMENTS

| | | | | |
|---|---|---|---|---|
| 728,003 | A | 5/1903 | Pfanschmidt et al. | |
| 1,175,671 | A | 3/1916 | Acklen | |
| 1,193,476 | A | 8/1916 | Block | |
| 1,460,927 | A | 7/1923 | Thompson et al. | |
| 2,067,268 | A | 1/1937 | Hans | |
| 2,128,217 | A | 8/1938 | Anderson | |
| 2,204,738 | A | 6/1940 | Swan | |
| 2,406,317 | A | 8/1946 | Bonde | |
| 2,742,251 | A | 4/1956 | Udvardy | |
| 2,879,765 | A | 3/1959 | Featherston | |
| 3,138,803 | A | 6/1964 | Caplan et al. | |
| 3,228,392 | A | 1/1966 | Speyer | |
| 3,534,733 | A | 10/1970 | Phipps et al. | |
| 3,644,943 | A | 2/1972 | Leonardo et al. | |
| 3,783,865 | A | 1/1974 | Ricketts | |
| 3,958,564 | A | 5/1976 | Langguth | |
| 3,994,032 | A | 11/1976 | Spickofsky | |
| 4,059,099 | A | 11/1977 | Davis | |
| 4,077,400 | A | 3/1978 | Harrigan | |
| 4,095,590 | A | 6/1978 | Harrigan | |
| 4,166,458 | A | 9/1979 | Harrigan | |
| 4,196,722 | A | 4/1980 | Vanderwoude | |
| 4,198,963 | A | 4/1980 | Barkalow et al. | |
| 4,237,872 | A | 12/1980 | Harrigan | |
| 4,429,688 | A | 2/1984 | Duffy | |
| 4,554,910 | A | 11/1985 | Lally | |
| 4,881,527 | A | 11/1989 | Lerman | |
| 5,114,006 | A | 5/1992 | Wilk | |
| 5,239,708 | A | 8/1993 | Irwin | |
| 5,295,481 | A | 3/1994 | Geeham | |
| 5,645,522 | A | 7/1997 | Lurie et al. | |
| 5,743,864 | A | 4/1998 | Baldwin, II | |
| 9,107,800 | B2 | 8/2015 | Sebelius et al. | |
| 2003/0181834 | A1* | 9/2003 | Sebelius | A61H 31/008 601/41 |
| 2004/0267325 | A1 | 12/2004 | Geheb et al. | |
| 2010/0004571 | A1 | 1/2010 | Nilsson | |
| 2010/0185127 | A1 | 7/2010 | Nilsson | |
| 2011/0201979 | A1* | 8/2011 | Voss | A61H 31/004 601/41 |
| 2012/0330200 | A1* | 12/2012 | Voss | A61H 31/004 601/41 |
| 2014/0094724 | A1 | 4/2014 | Freeman | |

FOREIGN PATENT DOCUMENTS

| | | | |
|---|---|---|---|
| DE | 804025 | C | 4/1951 |
| FR | 1476518 | A | 4/1967 |
| GB | 274306 | A | 7/1927 |
| GB | 1187274 | A | 4/1970 |
| WO | WO 1985/000018 | A1 | 1/1985 |
| WO | WO 2009/136831 | A1 | 11/2009 |
| WO | WO 2012/063163 | A1 | 5/2012 |
| WO | WO 2013/030700 | A1 | 3/2013 |

OTHER PUBLICATIONS

Cohen et al., "Active Compression-Decompression—A New Method of Cardiopulmonary Resuscitation", JAMA The Journal of the American Medical Association, (Jun. 3, 1992), vol. 267, No. 21, pp. 2916-2923.

Ambu International A/S, Copenhagen, DK, "Directions for Use Ambu.RTM. CardioPump.TM.", published in Sep. 1992, pp. 1-8.

European Patent Application No. 14171457.6; Extended Search Report; dated Nov. 20, 2014; 6 pages.

European Patent Application No. 17167256.1; Extended Search Report; dated Aug. 31, 2017; 7 pages.

* cited by examiner

V

MECHANICAL CPR DEVICE

CROSS REFERENCE TO RELATED APPLICATIONS

The present application is a continuation of U.S. patent application Ser. No. 14/137,721, filed Dec. 20, 2013, "Mechanical CPR Device With Automatic Suction Cup Attachment", which claims to the benefit of U.S. Provisional Patent Application 61/745,256, filed Dec. 21, 2012, and U.S. Provisional Patent Application 61/745,279, filed Dec. 21, 2012, the contents of each of which are hereby incorporated by reference in their entirety.

BACKGROUND

Cardiopulmonary resuscitation (CPR) is a medical procedure performed on patients to maintain some level of circulatory and respiratory functions when patients otherwise have limited or no circulatory and respiratory functions. CPR is generally not a procedure that restarts circulatory and respiratory functions, but can be effective to preserve enough circulatory and respiratory functions for a patient to survive until the patient's own circulatory and respiratory functions are restored. CPR typically includes frequent torso compressions that usually are performed by pushing on or around the patient's sternum while the patient is lying on the patient's back. For example, torso compressions can be performed as at a rate of about 100 compressions per minute and at a depth of about 5 cm per compression for an adult patient. The frequency and depth of compressions can vary based on a number of factors, such as valid CPR guidelines.

Mechanical CPR has several advantages over manual CPR. A person performing CPR, such as a medical first-responder, must exert considerable physical effort to maintain proper compression timing and depth. Over time, fatigue can set in and compressions can become less consistent and less effective. The person performing CPR must also divert mental attention to performing manual CPR properly and may not be able to focus on other tasks that could help the patient. For example, a person performing CPR at a rate of 100 compressions per minute would likely not be able to simultaneously prepare a defibrillator for use to attempt to restart the patient's heart. Mechanical compression devices can be used with CPR to perform compressions that would otherwise be done manually. Mechanical compression devices can provide advantages such as providing constant, proper compressions for sustained lengths of time without fatiguing, freeing medical personnel to perform other tasks besides CPR compressions, and being usable in smaller spaces than would be required by a person performing CPR compressions.

SUMMARY

Illustrative embodiments of the present application include, without limitation, methods, structures, and systems. In one embodiment, a mechanical CPR device can include a mechanism that can attach to a patient's torso, a driving component configured to extend the mechanism toward a patient's torso and retract the mechanism away from the patient's torso, and a controller. The controller can determine a reference position by at least controlling the driving component to extend the mechanism to a first position at which the mechanism comes into contact with the patient's torso, further extend the mechanism until a first threshold is reached, retract the mechanism until the mechanism is at the first position, further retract the mechanism from the first position until a second threshold is exceeded, and extend the mechanism to a second point at which the second threshold is no longer exceeded, the reference position being based at least in part on the second point. The controller can perform mechanical CPR by controlling the driving component to compress the patient's torso by extending the mechanism from the reference position to a depth and retracting the mechanism from the depth to the reference position, and actively decompress the patient's torso by retracting the mechanism from the reference position to a height above the reference position. As used in this context, to actively decompress, an external force is applied to the patient's torso to decompress the torso above the torso's natural resting position and/or above a reference position that is above the torso's natural resting position, as opposed to merely discontinuing the externally applied force and allowing the torso to expand by the natural resiliency of the torso. In one embodiment, the torso can be lifted up to 10% beyond the torso's natural resting position to actively expand the patient's torso during decompression.

In some examples, the controller can be configured to compress the patient's torso and actively decompress the patient's torso in a cycle based on a frequency. The frequency can be a predetermined frequency or a frequency entered by a user into the mechanical CPR device. The depth can be a predetermined depth, a depth entered by a user into the mechanical CPR device, or a depth based on a force used to compress the patient's torso. The height can be a predetermined height, a height entered by a user into the mechanical CPR device, or a height based on a force used to actively decompress the patient's torso.

In other examples, the mechanism is attached to an end of a piston, the first threshold can be a force threshold, and the mechanical CPR device can also include a force sensor to sense the force applied by the piston to cause air to be forced out from an area between the mechanism and the patient's torso. The second threshold can be a force threshold and the mechanical CPR device can also include a spring activation sensor configured to signal when the piston has been extended to exceed the second threshold. The spring activation sensor can also stop signaling when the piston has been extended to the second point at which the second threshold is no longer exceeded. One or both of the first and second thresholds can be a pressure threshold, and the mechanical CPR device can further include a pressure sensor configured to sense pressure in the area between the mechanism and the patient's torso. The controller can determine the reference position in response to the mechanical CPR device receiving a user input. The controller can also determine the reference position a predetermined number of times before performing mechanical CPR.

In another embodiment, a mechanism that can attach to a patient's torso on the end of a piston of a mechanical CPR device can be automatically attached to a patient's torso. The mechanical CPR device can extend the piston until a first position at which the mechanism comes into contact with the patient's torso. The piston can be further extended to cause air to be forced out from an area between the mechanism and the patient's torso until a first threshold is reached. The piston can be retracted until the mechanism is at the first position. The piston can be further retracted from the first position until a second threshold is exceeded. The piston can then be extended to a second point at which the second threshold is no longer exceeded.

In one example, each of the first and second thresholds is at least one of a force threshold, a distance threshold, or a pressure threshold. The mechanical CPR device can include a spring activation sensor to signal when the piston has been extract to exceed the threshold. The spring activation sensor can stop signaling when the piston has been extended to the second point at which the threshold is no longer exceeded.

In another embodiment, mechanical CPR can be performed by a mechanical CPR device. The mechanical CPR device can automatically attach a mechanism that can attach to a patient's torso of the mechanical CPR device to a patient's torso, automatically determine a reference position of the mechanism, extend the piston from the reference position to a particular depth below the reference position, retract the piston from the particular depth to a particular height above the reference position, and extend the piston from the particular height to the reference position.

In one example, extending the piston from the reference position to the particular depth and retracting the piston from the particular depth to the reference position causes compression of the patient's torso, and retracting the piston from the reference position to the particular height causes active decompression of the patient's torso. The compression of the patient's torso and the active decompression of the patient's torso can be performed a number of times in a cycle. The cycle can be performed based on a frequency, where the frequency is either a predetermined frequency or a frequency entered by a user into the mechanical CPR device. The particular depth can be a predetermined depth, a depth entered by a user into the mechanical CPR device, or a depth based on a force used to compress the patient's torso. The particular height can be a predetermined height, a height entered by a user into the mechanical CPR device, or a height based on a force used to actively decompress the patient's torso.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure.

DETAILED DESCRIPTION OF ILLUSTRATIVE EMBODIMENTS

Mechanical CPR compression devices can provide many advantages over manual CPR compressions. Mechanical CPR compression devices can include a back plate that is placed behind the back of the patient and a compression device located above the patient's sternum area. The compression device can be connected to the back plate on both sides of the patient. When the compression device pushes against the area around the patient's sternum, the back plate provides resistance that allows the compression device to compress the patient's torso. Such mechanical CPR compression devices surround the user's torso, such as in the case of a mechanical CPR device with a back plate behind the patient's back, a compression device above the patient's sternum, and legs along both sides of the user's torso.

Figure 1A:
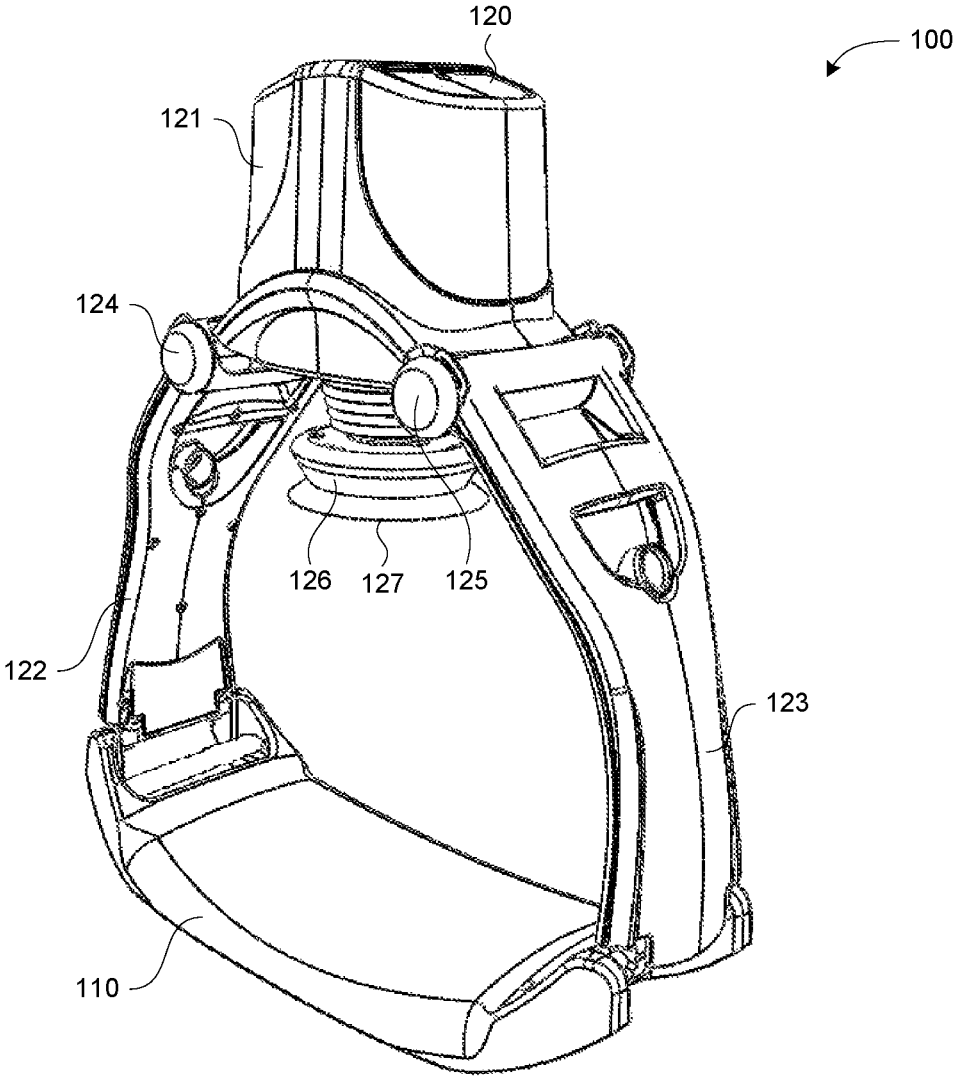
FIGS. 1A and 1B depict an isometric view and a side view, respectively, of one embodiment of a mechanical CPR device.
Figure 1B:
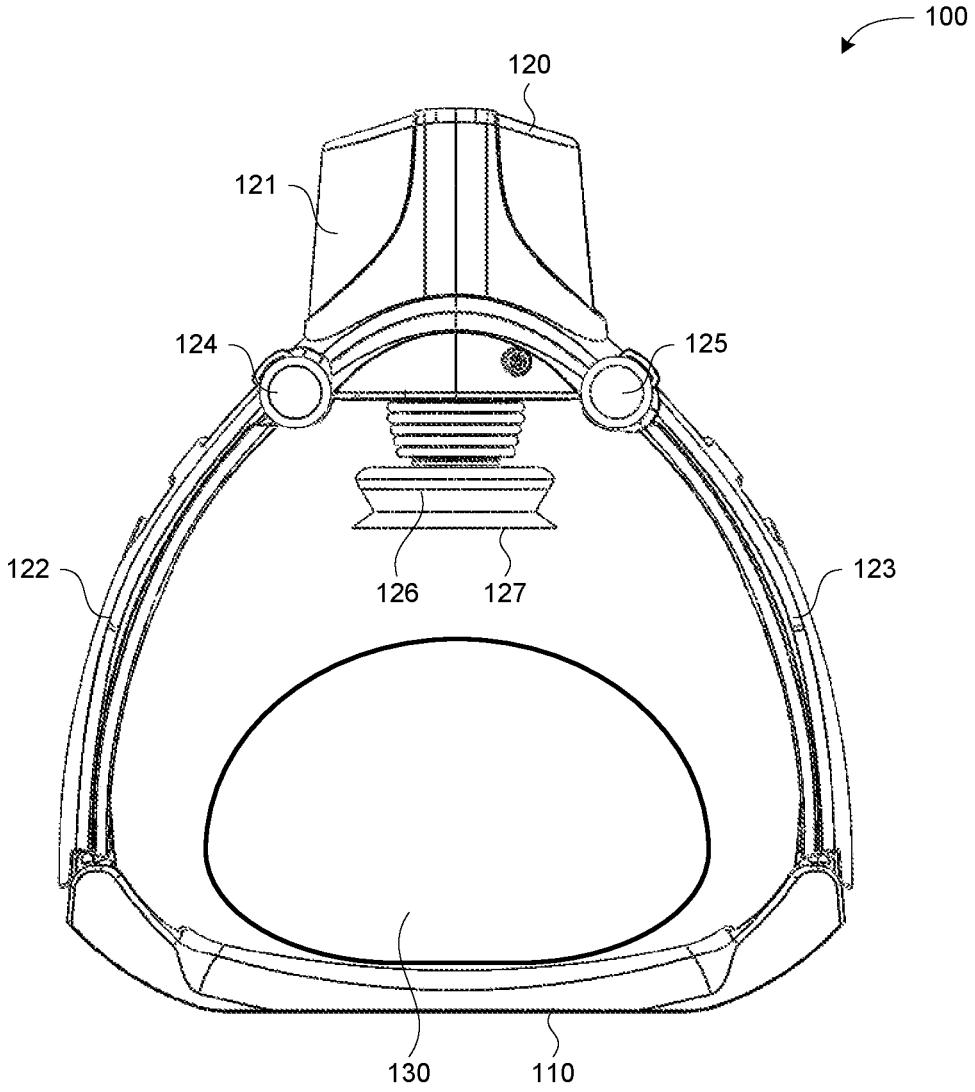

FIGS. 1A and 1B depict an isometric view and a side view, respectively, of one embodiment of a mechanical CPR device 100. The mechanical CPR device 100 includes a lower portion 110 and an upper portion 120. The lower portion 110 can be in the form of a back plate that can be placed under the back of a patient. The upper portion 120 can have a main portion 121 and two legs 122 and 123. Each of the legs 122 and 123 can be releasably connected to one of the sides of the lower portion 110. Items that are releasably connected are easily disconnected by a user, such as connections that can snap in and snap out, connection that do not require the use of tools to disconnect, quick-release connections (e.g., push button release, quarter-turn fastener release, lever release, etc.), and the like. Items are not releasably connected if they are connected by more permanent fasteners, such as rivets, screws, bolts, and the like. In the embodiment shown in FIGS. 1A and 1B, the legs 122 and 123 are rotatably attached to the main portion 121 about axes 124 and 125, respectively. However, in other embodiments, the legs 122 and 123 can also be fixed with respect to the main portion 121.

The main portion 121 can include a piston 126 with an end 127. The end 127 can be blunt, contoured, or otherwise configured to interact with a patient's torso. The end 127 can also have a suction cup that can temporarily attach to a patient's torso. The main portion 121 can include other components. For example, the main portion 121 can include a driving component, such as a motor or actuator, that can extend and retract the piston 126. The main portion 121 can include a power source, such as a rechargeable battery, that can provide power for the driving component. The main portion 121 can also include a controller that can control the movement of the piston 126 by controlling the driving component. In one embodiment, the controller can include a processor and memory, and the memory stores instructions that can be executed by the processor. The instructions can include instructions for controlling the piston 126 by controlling the driving component. The main portion 121 can also include one or more sensors that can provide inputs to the controller. The one or more sensors can include one or more of a force sensor to sense a force exerted by the piston 126, a spring sensor to sense a displacement of the piston 126, a current sensor to sense an amount of current drawn by the driving component, or any other type of sensor. The main portion 121 can also include one or more user input mechanisms, such as buttons, keys, displays, and the like. A user can input information to adjust the operation of the mechanical CPR device 100, such as a depth of compressions, a frequency of compressions, a maximum exertion force by the piston 126, and the like.

In addition to the mechanical CPR device 100, FIG. 1B also depicts a cross section of a patient's torso 130 with the patient's back against the lower portion 110 and the patient's chest facing the piston 126. While in the configuration depicted in FIG. 1B, the piston can be extended to the patient's torso 130, compress the patient's torso 130, and retract from the patient's torso. This process, wherein the piston 126 compresses the patient's torso 130 and is then retracted from the patient's torso, can be performed repeatedly to mechanically perform CPR.

FIGS. 2A to 2F depict embodiments of a system and a method for automatically attaching a suction cup of the mechanical CPR device 220 to a patient's torso 210 and automatically determining a reference position for a piston with respect to a patient's torso 210. FIGS. 2A to 2F depict a portion of a mechanical CPR device 220 that includes a piston 221. The end of the piston 221 includes a suction cup 222. The depictions in FIGS. 2A to 2F show cross sectional views of the mechanical CPR device 220, the piston 221, and the suction cup 222. The mechanical CPR device 220 could also include other components that are not depicted in FIGS. 2A to 2F, such as a back plate, legs to couple the depicted portions of the mechanical CPR device 220 to the back plate, and the like.

Figure 2A:
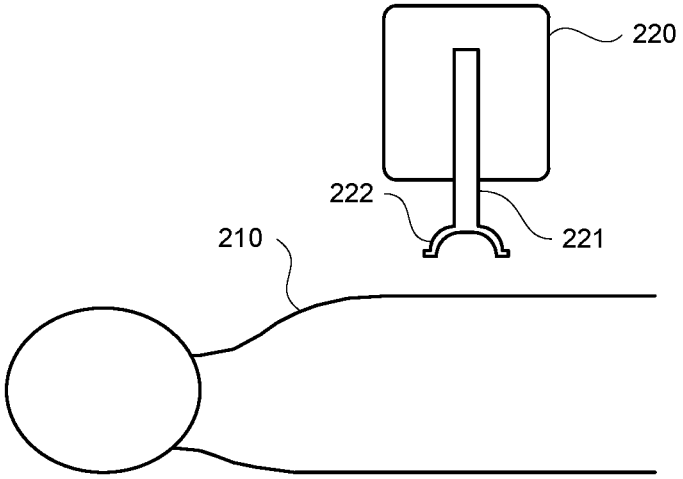
FIGS. 2A, 2B, 2C, 2D, 2E, and 2F depict embodiments of a system and a method for automatically attaching a suction cup of the mechanical CPR device to a patient's torso and automatically determining a reference position for a piston with respect to a patient's torso.

In FIG. 2A, the piston is fully retracted into the mechanical CPR device 220. In this position the suction cup 222 is not in contact with the patient's torso 210. From the position depicted in FIG. 2A, the piston 221 can be extended until the piston 221 is in the position depicted in FIG. 2B where the suction cup 222 is in contact with the patient's torso 210. The piston 221 can be extended by a driving component, such as a motor or an actuator, in the mechanical CPR device 220. A controller in the mechanical CPR device 220 can also control the driving component.

Figure 2B:
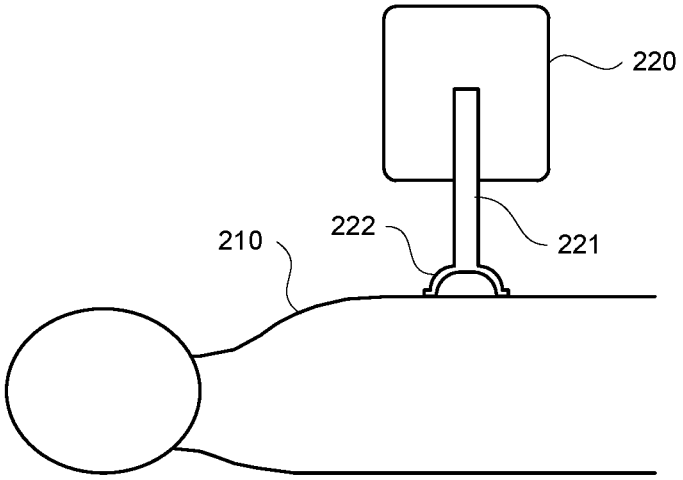
Figure 2C:
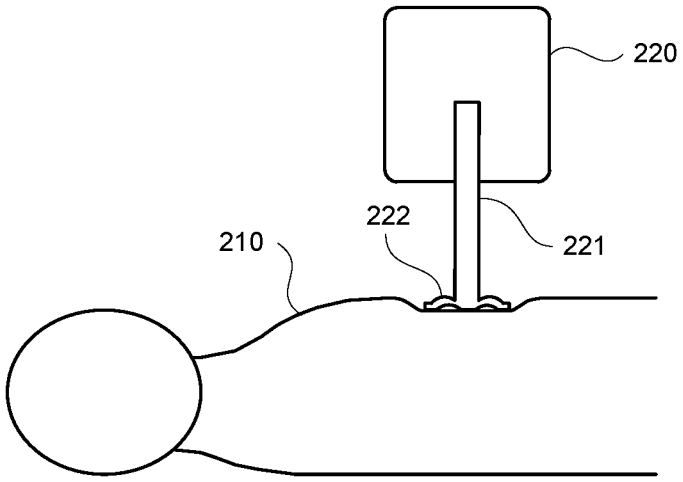

From the position depicted in FIG. 2B, the piston 221 can be further extended toward the patient's torso 210 until a threshold is reached so that air is forced out from the lower side of the suction cup 222, such as in the position depicted in FIG. 2C. In one example, the threshold can be a force threshold and the controller in the mechanical CPR device 220 can measure the force exerted by the piston 221 as the air is forced out from the lower side of the suction cup 222. Once the force exerted on the by the piston 221 reaches the force threshold, the controller can stop the piston 221 from being extended any further. In another example, the threshold can be a distance threshold and the controller in the mechanical CPR device 220 can measure the distance travelled by the piston 221 as the air is forced out from the lower side of the suction cup 222. Once the distance travelled by the piston 221 reaches the distance threshold, the controller can stop the piston 221 from being extended any further. In yet another example, the threshold can be a pressure threshold and a pressure sensor can sense the pressure in the area between the suction cup 222 and the patient's torso 210. As the air is forced out from the lower side of the suction cup 222, the pressure sensor will sense a reduction in pressure. Once the pressure reaches the pressure threshold, the controller in the mechanical CPR device 220 can stop the piston 221 from being extended any further. In any of these examples, the patient's torso 210 may be compressed to some extent as the piston 221 is extended, such as in the depiction in FIG. 2C. At the point depicted in FIG. 2C, the suction cup 222 is attached to the patient's torso 210 from the vacuum created by the air forced out of the lower side of the suction cup 222.

Figure 2D:
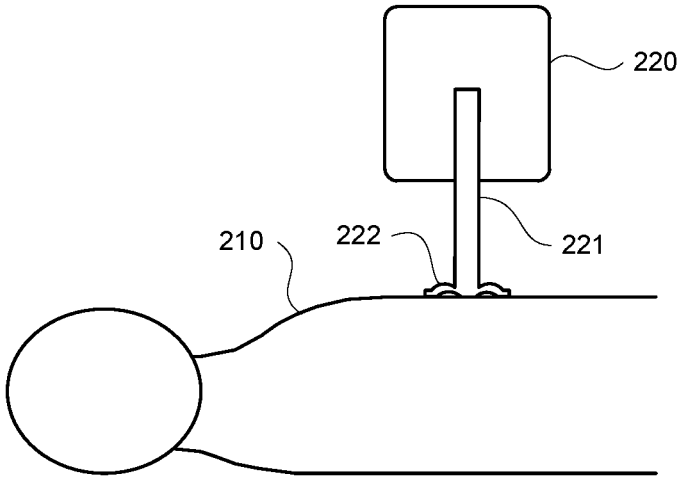

From the position depicted in FIG. 2C, the piston 221 can be retracted to the position depicted in FIG. 2D where the suction cup 222 originally came into contact with the patient's torso 210. From the position depicted in FIG. 2D, the piston 221 can be further retracted until the point depicted in FIG. 2E where the piston 221 reaches a second threshold. The second threshold can be a force threshold, such as a force exerted when pulling up on the patient's torso 210. This second threshold can be measured by a spring activation sensor or other force sensor. For example, the piston 221 can be retracted until the spring activation sensor is activated and then the driving component can stop retracting the piston 221. From the position depicted in FIG. 2E, the piston 221 can be slowly extended back toward the patient's torso 210 until the location depicted in FIG. 2F where the piston 221 no longer exceeds the second threshold. At this position, the location of the suction cup 222 can define a reference position 230 for the piston 221.

As described in greater detail below, the reference position 230 can be a position from which the depth of CPR compressions and the height of CPR decompressions can be measured. Defining and using reference position 230 as a position from which to measure the depth of CPR compressions and the height of CPR decompressions can help to avoid unintended injury to a patient. For example, a manual CPR device can be placed on a patient's torso and a user can manually push or pull on the manual CPR device to cause compressions or decompressions. However, the user of the manual CPR device does not have any reference position from which to measure the depth of compressions or the height of decompressions. Without a reference position, the user can cause additional injuries to the patient. For example, if the user pushes the manual CPR device down too far into the patient's chest during a compression, the compression might break one or more of the patient's ribs. When one or more of the patient's ribs are broken, it may be easier to compress the patient's chest and a subsequent compression by user of the manual CPR device can cause even more of the patient's ribs to be broken, and injury to the patient's internal organs. In contrast, establishing reference position 230 with respect to the patient's torso 210 can prevent CPR compressions from extending too deep. Moreover, even if one injury does occur (e.g., the breaking of a patient's rib), the reference position 230 will not change and the likelihood that a subsequent compression will cause even further injury can be reduced.

Figure 2E:
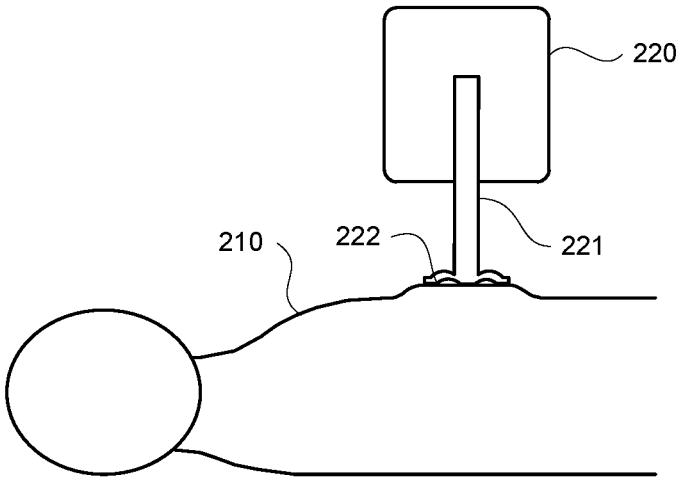
Figure 2F:
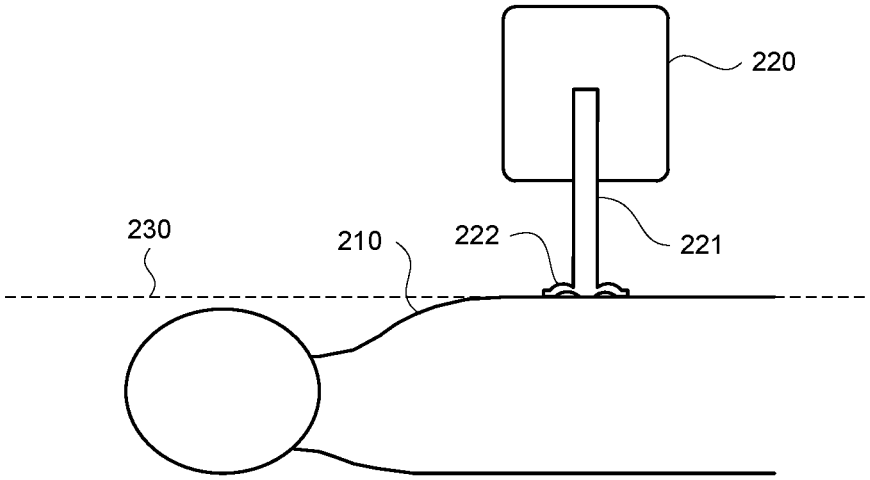

In addition to merely using a reference position 230, establishing a proper location for the reference position 230 can also help to avoid unintended injury to a patient. Retracting the piston 221 until the second threshold is exceeded and then extending the piston 221 until the second threshold is no longer exceeded (as shown in FIGS. 2E and 2F) can establish a reference position 230 that is closer to the natural resting position of the patient's torso 210. Using a reference position 230 that is close to the natural resting position of the patient's torso 210 can help to avoid unintended injury to a patient. For example, if the point at which the suction cup attached to the patient's torso 210 (i.e., the point shown in FIG. 2C) was used as reference position, the reference position could be too low. If CPR compressions were measured from this low reference position, the depth of CPR compressions could cause injury such as breaking the patient's ribs, bruising the patient's internal organs, and the like. In another example, if the point at which the second threshold is exceeded (i.e., the point shown in FIG. 2E) was used as a reference position, the reference could be too high. In such a case, the CPR compressions would not extend low enough to properly compress the patient's torso 210 and decompression of the patient's torso 210 would go higher than desired and possibly cause damage from overstretching.

Using a reference position can also be beneficial is circumstances where the patient is not located in a stable or a flat position. For example, if a patient is being transported, such as on a stretcher or an ambulance, the patient may be jostled around or otherwise not in a stable position. However, if the mechanical CPR device is moving with the patient (e.g., if mechanical CPR is being performed in an ambulance while the patient is being transported), the reference position of the piston or suction cup can remain relatively fixed with respect to the patient and the mechanical CPR device can avoid over-compression and over-decompression. Thus, the benefits of avoiding unintended injury could still be realized if the patient is otherwise moving. In another example, the patient can be located in a position that is not flat, such as if the patient is being transported down stairs or the patient is on rough terrain. In these cases, if the mechanical CPR device is located with the patient in the same non-flat position, the reference position used by the mechanical CPR device would reflect the patient's non-flat position and the mechanical CPR device could avoid over-compression and over-decompression. A user performing manual CPR under such conditions may have difficulty in maintaining a desired compression depth and/or decompression height.

A number of other benefits can be realized using the process depicted in FIGS. 2A to 2F. One example is that the process depicted in FIGS. 2A to 2F can be used to automatically attach the suction cup 222 to the patient's torso 210. A controller in the mechanical CPR device 220 can control the movements of the piston 221 to perform the entire process depicted in FIGS. 2A to 2F. In this way, the suction cup 222 can be attached to the patient's torso 210 without manual intervention by a user of the mechanical CPR device 220. A user can initiate the process of depicted in FIGS. 2A to 2F, such as by pressing a particular button or key on the mechanical CPR device 220. However, once the process depicted in FIGS. 2A to 2F in initiated, the mechanical CPR device 220 can automatically attached the suction cup 222 to the patient's torso. The process depicted in FIGS. 2A to 2F can be repeated a number of times, such as three times, to ensure that the suction cup 222 is attached to the patient's chest and/or to ensure that the reference position 230 was determined correctly. In one embodiment, the reference position 230 can be determined more than one time and the average measurement of the location of the reference position 230 can be used as a reference for CPR compressions and CPR decompressions. Another example is that the process depicted in FIGS. 2A to 2F can define a reference position 230 of the piston 221 with respect to the patient's torso 210. The reference position 230 of the piston 221 with respect to the patient's torso 210 may vary from patient to patient as different patients may have torsos of different sizes.

Figure 3:
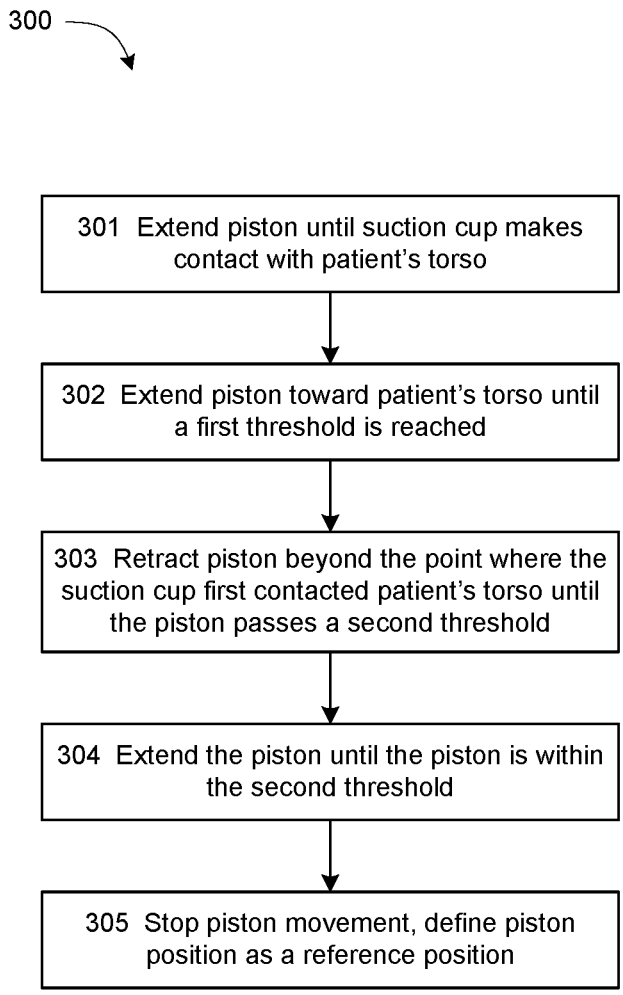
FIG. 3 depicts an example of a method of automatically attaching a suction cup of a mechanical CPR device to a patient's torso and of automatically determining a reference position for a piston with respect to a patient's torso.

FIG. 3 depicts an example of a method 300 of automatically attaching a suction cup of a mechanical CPR device to a patient's torso and of automatically determining a reference position for a piston with respect to a patient's torso. At block 301, a piston can be extended until a suction cup on the end of the piston makes contact with a patient's torso. At block 302, the piston can be further extended until a first threshold is reached. The first threshold can be a threshold amount of force exerted by the piston on the patient's torso. In this instance, the first threshold can be an amount of force that will forced air out from the lower side of the suction cup to create a vacuum between the suction cup and the patient's torso. The first threshold can also be a distance threshold relating to the distance travelled by the piston, a pressure threshold relating to the pressure between the suction cup and the patient's torso, or any other type of threshold.

At block 303, the piston can be retracted beyond the point at which the suction cup first contacted the patient's torso until a second threshold is passed. The second threshold can be a force threshold that is passed when the force used to perform the active decompression is greater than the second threshold. The second threshold can also be a distance threshold relating to the distance travelled by the piston, a pressure threshold relating to the pressure between the suction cup and the patient's torso, or any other type of threshold. The point at which the second threshold has been passed can be signaled by a spring activation sensor. Retracting the piston in this way ensures that the suction cup is properly attached to the patient's torso. At block 304, the piston can be extended back toward the patient's torso until the point that the second threshold is no longer exceeded. In the case where a spring activation sensor is used, the spring activation sensor signal can cease once the piston no longer exceeds the second threshold. At block 305, the piston can be stopped and the location of the piston at that point can be defined as a reference position. At this point, the suction cup is attached to the patient's torso and the reference position can be used during mechanical CPR for compression and active decompression.

The method 300 depicted in FIG. 3 can be performed by a mechanical CPR device. A controller in the mechanical CPR device can be configured to perform each of the steps depicted in method 300. The mechanical CPR device can include executable instructions that, when executed by the mechanical CPR device, cause the mechanical CPR device to performing the method 300.

FIGS. 4A to 4E depict a system and method of performing one cycle of mechanical CPR that includes both compression and active decompression. Depicted in FIGS. 4A to 4E are a patient's torso 410 and a portion of a mechanical CPR device 420. The mechanical CPR device 420 includes a piston 421 and a suction cup 422 on the end of the piston 421. At the point depicted in FIG. 4A, the suction cup 422 is attached to the patient's torso 410. The suction cup 422 could have been automatically attached to the patient's torso 410 using a method, such as the one depicted in FIGS. 2A to 2F or in FIG. 3. Also at the point depicted in FIG. 4A, the suction cup 422 is located at a reference position 430. The reference position 430 could have been automatically determined using a method, such as the one depicted in FIGS. 2A to 2F or in FIG. 3. While the reference position 430 can be set in automatically by the mechanical CPR device 420, the reference position 430 can be set in in a number of other ways. For example, the reference position 430 can be set in manually by a user, such as by manually adjusting the reference position 430 after an initial automatic or manual setting of the reference position 430.

Figure 4A:
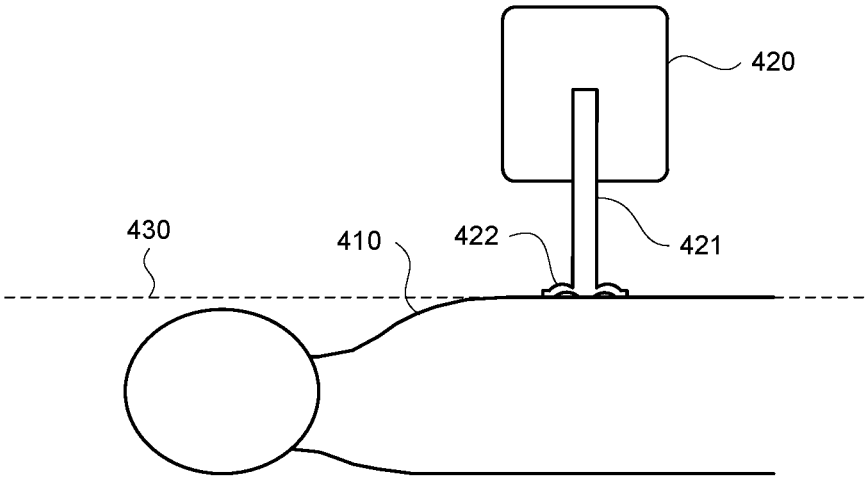
FIGS. 4A, 4B, 4C, 4D, and 4E depict a system and method of performing one cycle of mechanical CPR that includes both compression and active decompression.
Figure 4B:
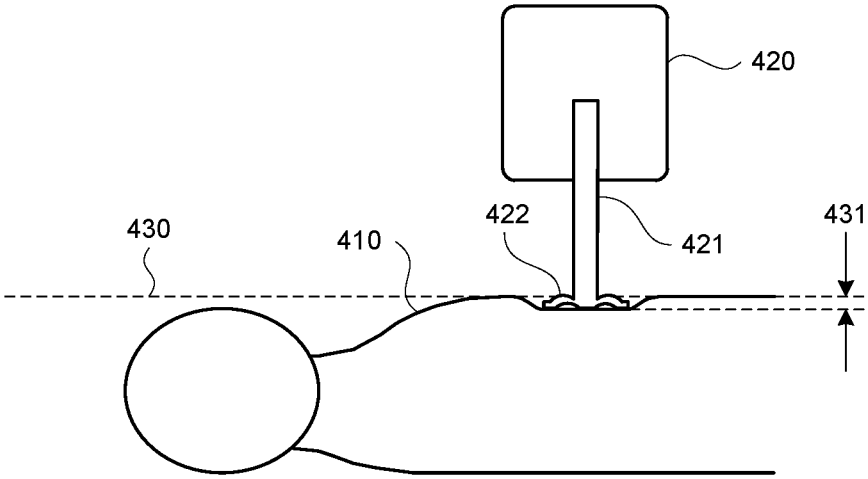

From the point depicted in FIG. 4A, the piston can be extended to compress the patient's torso 410 until it reaches the point depicted in FIG. 4B. In FIG. 4B, a portion of the patient's torso 410 has been compressed to a depth 431. The depth 431 can be a predetermined depth, a depth entered by a user into a user interface of the mechanical CPR device 420, a depth based on the force required to compress the patient's torso 410, or any other depth. From the point depicted in FIG. 4B, the piston can be retracted until the point shown in FIG. 4C where the suction cup 422 is back at the reference position 430.

Figure 4C:
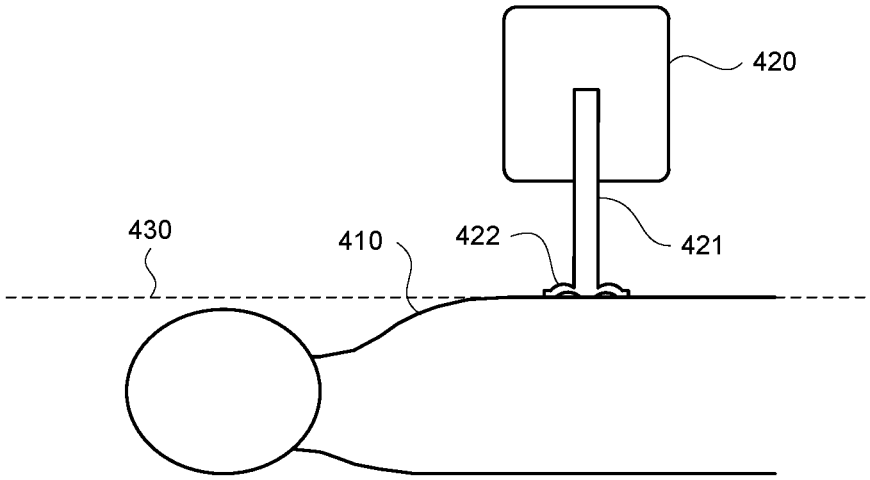
Figure 4D:
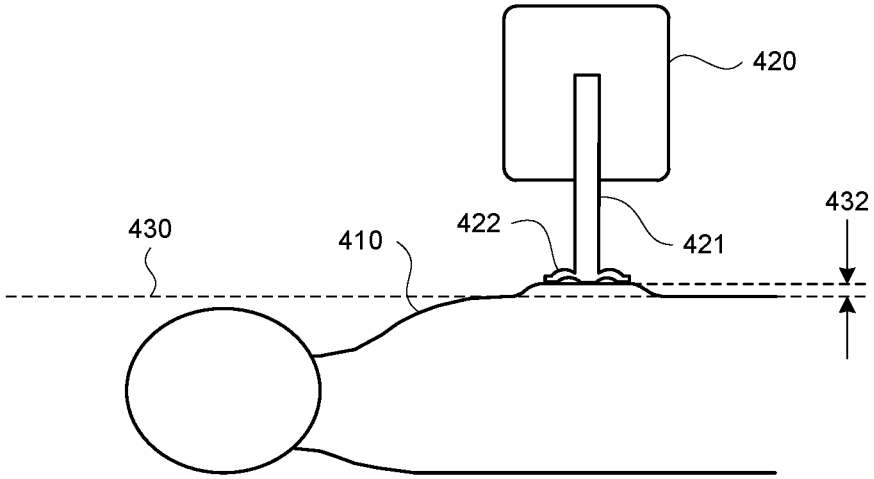
Figure 4E:
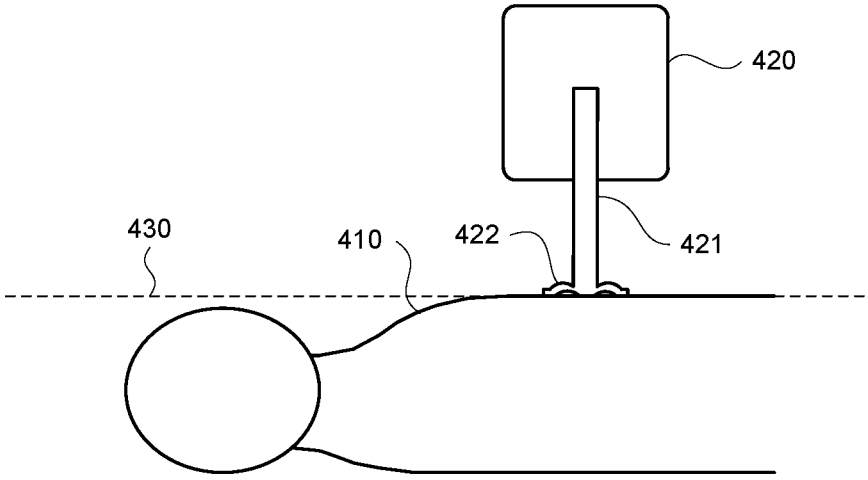

From the point depicted in FIG. 4C, the piston can be retracted to actively decompress the patient's torso 410 until it reaches the point depicted in FIG. 4C. In FIG. 4B, a portion of the patient's torso 410 has been actively decompressed to a height 432. The height 432 can be a predetermined height, a height entered by a user into a user interface of the mechanical CPR device 420, a height based on the force required to actively decompress the patient's torso 410, or any other depth. From the point depicted in FIG. 4D, the piston can be extended until the point shown in FIG. 4E where the suction cup 422 is back at the reference position 430.

The cycle of compression and decompression depicted in FIGS. 4A to 4E can be repeated any number of times as part of a mechanical CPR process. The active decompression that is part of the cycle can increase the effectiveness of the mechanical CPR. For example, adding active decompression to the mechanical CPR method can improves the venous return flow of blood back to the heart which can improve the patient's cardiac output. The frequency with which the cycle is repeated can be a predetermined frequency, a frequency entered by a user into a user interface of the mechanical CPR device 420, or any other frequency.

In the cycle of compression and decompression depicted in FIGS. 4A to 4E, the piston 421 does not need to stop at each of the positions depicted in FIGS. 4A to 4E. For example, when the piston 421 is at the location depicted in FIG. 4B (i.e., where the suction cup 422 has been extended to the depth 431 below the reference position 430), the piston 421 can be retracted without interruption from that position to the position depicted in FIG. 4D (i.e., where the suction cup 422 has been retracted to the height 432 above the reference position 430). During this movement, the piston 421 will pass through the position shown in FIG. 4C (i.e., where the suction cup 422 is at the reference position 430), but not stop at the position shown in FIG. 4C. In this way, the position of the piston 431 during repeated cycle of compression and decompression can be represented by a square wave, by a sine wave, or by any other wave pattern. In the square wave example, the piston 421 can extend to the depth 431 below the reference position 430, wait at the depth 431 below the reference position 430 for a time, retract from the depth 431 below the reference position 430 to the height 432 above the reference position 430, wait for a time, extend to the depth 431 below the reference position 430, and so forth.

Figure 6A:
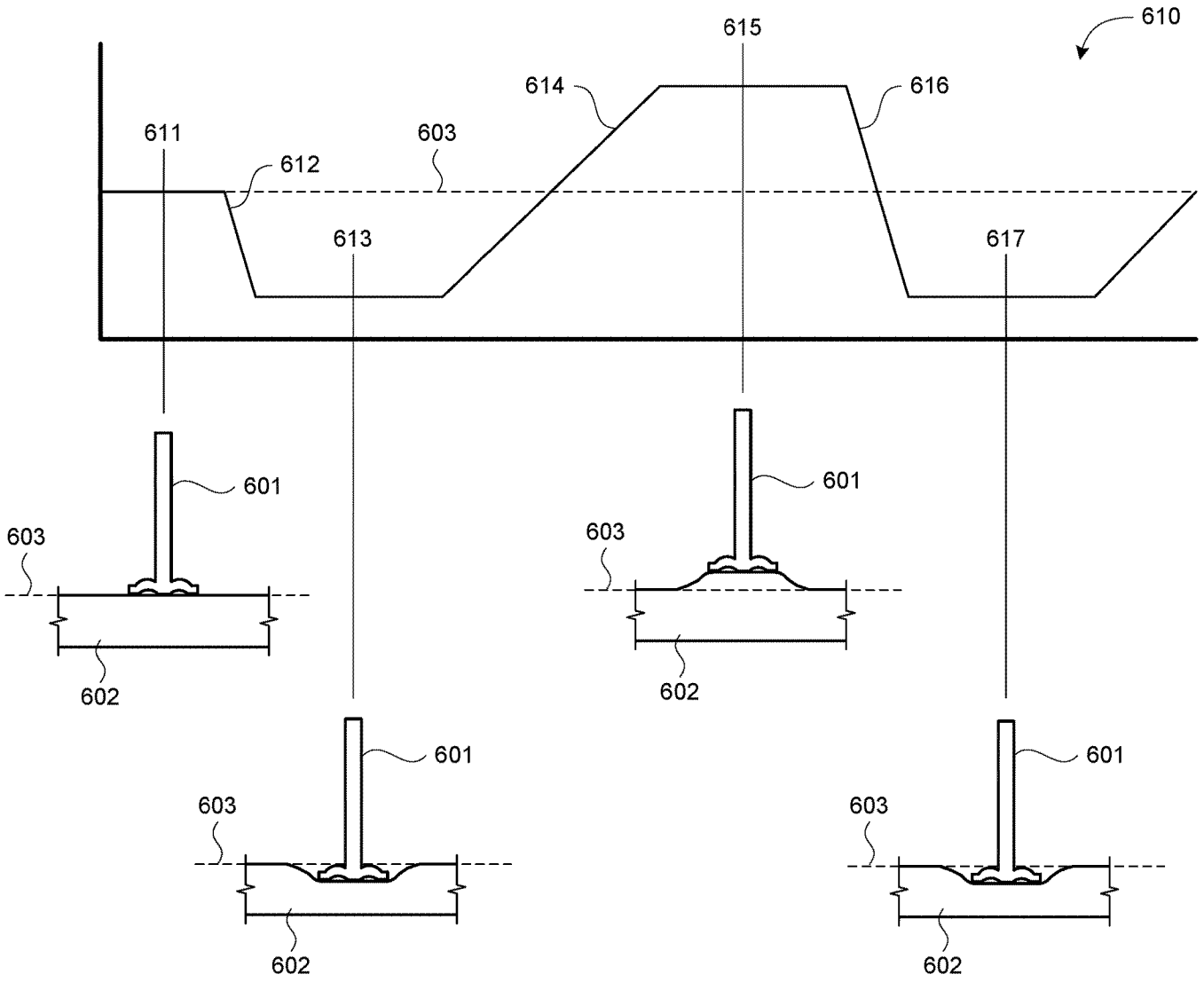
FIGS. 6A, 6B, and 6C depict different wave forms representing positions of a piston with respect to a reference position during compression and decompression of a patient's torso.
Figure 6B:
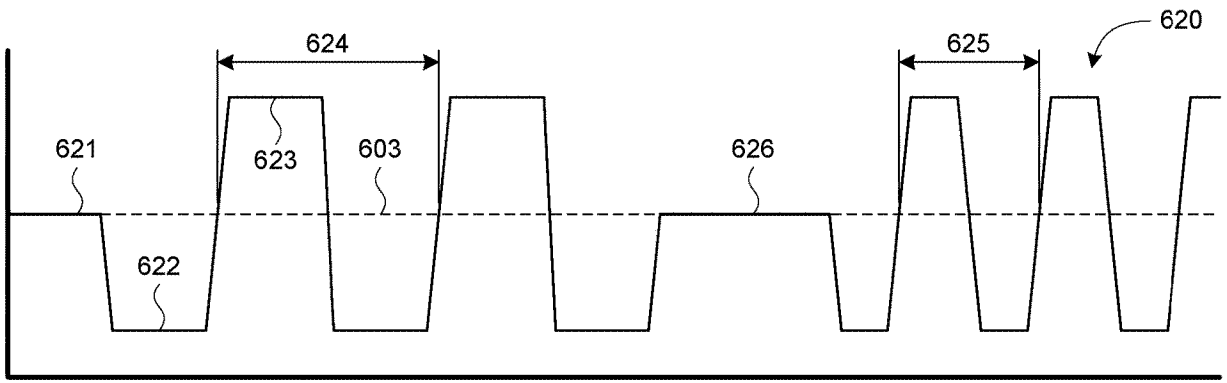
Figure 6C:
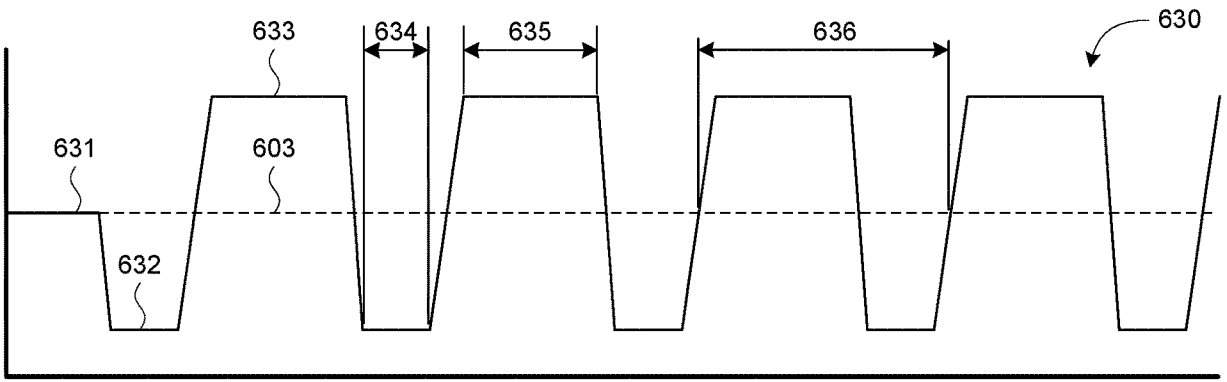

FIGS. 6A to 6C depict different wave forms representing positions of a piston 601 with respect to a reference position 603 during compression and decompression of a patient's torso 602. In the example depicted in FIG. 6A, a chart 610 plots the position of a suction cup of the piston 601 over time. The chart 610 also depicts a height of the reference position 603. At time 601, the suction cup of the piston 601 is at the reference point. The piston can be extended to compress the patient's torso 602, as shown by downward slope 612 on the chart, until the suction cup reaches a particular depth below reference position 603. The position of the suction cup at the particular depth below reference position 603 is shown at point 613. The piston can remain in the position shown at point 613 for a time and then be retracted, as shown by upward slope 614, to decompress the patient's torso 602 until the suction cup reaches a particular height above reference position 603. The position of the suction cup at the particular height above reference position 603 is shown at point 615. The piston can remain in the position shown at point 615 for a time and then be extended, as shown by downward slope 616, to compress the patient's torso 602 until the suction cup again reaches the particular depth below the reference position 603. The position of the suction cup at the particular depth below reference position 603 is again shown at point 617. As shown in this particular embodiment, the speeds at which the piston is extended and retracted can be different. For example, the downward slope 616 is steeper than the upward slope 614, indicating that speed of extending the piston during downward slope 616 is greater than the speed of retracting the piston during upward slope 614. This scenario may allow for blood to be drawn slowly into the patient's heart during decompression and then quickly pumped out of the heart during compression. Other speeds and differences in speeds are possible.

FIG. 6B depicts a chart 620 representing heights of a suction cup on a piston with respect to reference position 603. At point 621, the suction cup can be located at the reference point. From there, a series of cycles of compression and decompression proceed. The compressions are made as the piston is extended until the suction cup reaches a particular depth below the reference position 603, as shown by the position at point 622. The decompressions are made as the piston is retracted until the suction cup reaches a particular height above the reference position 603, as shown by the position at point 623. In this particular embodiment, the cycles are performed at different frequencies. For example, cycles on the left side of the chart 620, such as cycle 624, are performed at a first frequency, and cycles on the right side of the chart 620, such as cycle 625, are performed at a second frequency. In this particular example the second frequency is higher than the first frequency. A low frequency in the first part of the chart 620 and a high frequency in the second part of the chart 620 may aid in preventing reperfusion injury or other injuries. In addition, the mechanical CPR machine may pause for a period, such as the rest period 626 depicted in FIG. 6B, between different frequencies of operation. Other patterns of frequencies are possible and can be predetermined frequencies or user-entered frequencies. In one embodiment, the mechanical CPR device can perform compressions for a time without first defining a reference position and then rest for a time. During the rest time, the mechanical CPR device can define a reference position. After the rest time, the mechanical CPR device can perform compressions and active decompressions using the defined reference position to measure depth and height.

FIG. 6C depicts a chart 630 representing heights of a suction cup on a piston with respect to reference position 603. At point 631, the suction cup can be located at the reference point. From there, a series of cycles of compression and decompression proceed. The compressions are made as the piston is extended until the suction cup reaches a particular depth below the reference position 603, as shown by the position at point 632. The decompressions are made as the piston is retracted until the suction cup reaches a particular height above the reference position 603, as shown by the position at point 633. In chart 630, different duty cycles for compression and decompression are depicted. A duty cycle is a percentage of one period during which a particular characteristic is true. For example, the compression duty cycle can be measured as the percentage of one period during which the patient's torso is compressed. In FIG. 6C, chart 630 depicts that compressions are held for a first period of time 634 and decompressions are performed for a second period of time 635. One full cycle or period takes a third period of time 636. The compression duty cycle is the percentage the third period of time 636 taken up by the first period of time 634 and the decompression duty cycle is the percentage the third period of time 636 taken up by the second period of time 635. In the example of FIG. 6C, the compression duty cycle is a lower percentage than the decompression duty cycle because the first period of time 634 is less than the second period of time 635. Any duty cycle for the wave form (i.e., either the compression duty cycle or the decompression duty cycle) can be a predetermined duty cycle or a user-entered duty cycle.

Figure 5:
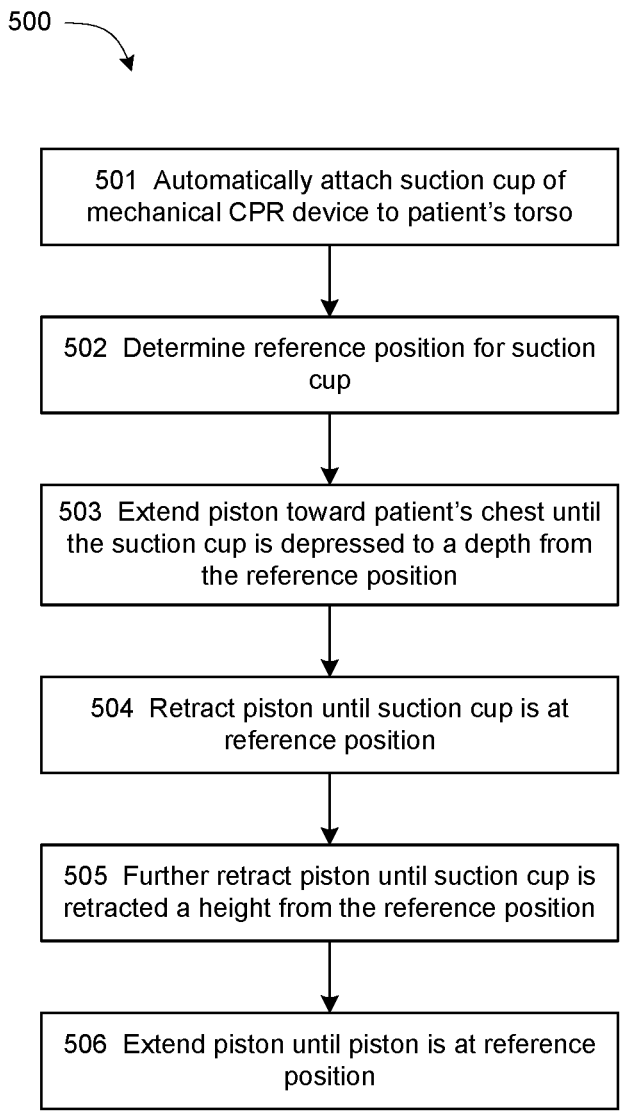
FIG. 5 depicts an example of a method of performing one cycle of mechanical CPR that includes both compression and active decompression.

FIG. 5 depicts an example of a method 500 of performing one cycle of mechanical CPR that includes both compression and active decompression. At block 501, a suction cup of a mechanical CPR device can be automatically attached to a patient's torso. At block 502, a reference position of the suction cup can be determined. As described above with respect to the methods depicted in FIGS. 2A to 2F or in FIG. 3, automatically attaching a suction cup of a mechanical CPR device and determining a reference position of the suction cup can be performed in the same process. Both automatically attaching a suction cup of a mechanical CPR device and determining a reference position of the suction cup can be performed by the mechanical CPR device.

At block 503, the piston can be extended until the suction cup is depressed a certain depth from the reference position. Extending the piston in this manner will cause the suction cup to compress the patient's torso. The depth can be a predetermined depth, a depth entered by a user into a user interface of the mechanical CPR device, a depth based on the force required to compress the patient's torso, or any other depth. At block 504, the piston can be retracted until the suction cup is returned to the reference position. At that point, the patient's torso is no longer in compression.

At block 505, the piston can be retracted until the suction cup is withdrawn a certain height from the reference position. Retracting the piston in this manner will cause the suction cup to actively decompress the patient's torso. The height can be a predetermined height, a height entered by a user into a user interface of the mechanical CPR device, a height based on the force required to actively decompress the patient's torso, or any other height. At block 506, the piston can be extended again until the suction cup is returned to the reference position. At that point, the patient's torso is no longer in active decompression.

When performing the method 500 depicted in FIG. 5, the piston does not need to stop moving after each of the steps described in method 500. For example, while block 504 indicates that the piston is retracted until the suction cup is at the reference position and block 505 indicates that the piston is further retracted until the suction cup is at the height above the reference position, the piston does not need to stop at the reference position. The piston can continuously move from the position at which the suction cup is at the depth below the reference position until the suction cup is at the height above the reference position. In another example, while block 506 indicates that the piston is extended until the suction cup is at the reference position, the piston can continue to move until the suction cup is at the depth below the reference position to start another cycle.

In any of the above examples, a suction cup can become disengaged from the patient's torso during CPR. The disengagement can be measured in a number of ways, such as by a pressure sensor configured to measure the pressure below the suction cup, a sensor that measures the force used during decompression, and the like. In such a case, the mechanical CPR device an automatically reattach the suction cup to the patient's torso and/or provide an alert (e.g., audio alert via a speaker, visual alert via a warning light, etc.). The suction cup can be reattached to the patient's torso using the same method that it was originally attached to the suction cup, such as using the process depicted in FIGS. 2A to 2F. The mechanical CPR device can store data about a disengagement event in memory for later analysis. After reattachment, the mechanical CPR device can also modify its operation, such as by changing the compression and decompression waveform, changing the amount of force used to extend and retract the piston, changing the speed at which the piston is extend and/or retracted, etc.

In a number of embodiments discussed here, a suction cup has been described on the end of a piston. The suction cup can attach to a patient's torso so that, among other benefits, active decompression is possible. However, other mechanisms could be used to attach an end of the piston to a patient's torso. For example, a sticker plate configured to stick to patient's torso could be used on the end of the piston to attach to a patient's torso to the piston. In many of the above embodiments, the suction cup could be replaced with a sticker plate. Similarly, the suction cup in many of the above embodiments could be replaced with any number of other mechanisms that can attach to a patient's torso to the piston.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

In general, the various features and processes described above may be used independently of one another, or may be combined in different ways. For example, this disclosure includes other combinations and sub-combinations equivalent to: extracting an individual feature from one embodiment and inserting such feature into another embodiment; removing one or more features from an embodiment; or both removing a feature from an embodiment and adding a feature extracted from another embodiment, while providing the advantages of the features incorporated in such combinations and sub-combinations irrespective of other features in relation to which it is described. All possible combinations and subcombinations are intended to fall within the scope of this disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed example examples. The example systems and components described herein may be configured differently than described. For example, elements may be added to, removed from, or rearranged compared to the disclosed example examples.

Each of the processes, methods and algorithms described in the preceding sections may be embodied in, and fully or partially automated by, code modules executed by one or more computers or computer processors. The code modules may be stored on any type of non-transitory computer-readable medium or computer storage device, such as hard drives, solid state memory, optical disc and/or the like. The processes and algorithms may be implemented partially or wholly in application-specific circuitry. The results of the disclosed processes and process steps may be stored, persistently or otherwise, in any type of non-transitory computer storage such as, e.g., volatile or non-volatile storage.

It will also be appreciated that various items are illustrated as being stored in memory or on storage while being used, and that these items or portions of thereof may be transferred between memory and other storage devices for purposes of memory management and data integrity. Alternatively, in other embodiments some or all of the software modules and/or systems may execute in memory on another device and communicate with the illustrated computing systems via inter-computer communication. Furthermore, in some embodiments, some or all of the systems and/or modules may be implemented or provided in other ways, such as at least partially in firmware and/or hardware, including, but not limited to, one or more application-specific integrated circuits (ASICs), standard integrated circuits, controllers (e.g., by executing appropriate instructions, and including microcontrollers and/or embedded controllers), field-programmable gate arrays (FPGAs), complex programmable logic devices (CPLDs), etc. Some or all of the modules, systems and data structures may also be stored (e.g., as software instructions or structured data) on a computer-readable medium, such as a hard disk, a memory, a network or a portable media article to be read by an appropriate drive or via an appropriate connection. Such computer program products may also take other forms in other embodiments. Accordingly, the present invention may be practiced with other computer system configurations.

While certain example or illustrative examples have been described, these examples have been presented by way of example only, and are not intended to limit the scope of the inventions disclosed herein. Indeed, the novel methods and systems described herein may be embodied in a variety of other forms. The accompanying claims and their equivalents are intended to cover such forms or modifications as would fall within the scope and spirit of certain of the inventions disclosed herein.

What is claimed:

1. A mechanical CPR device, comprising:

a mechanism configured to attach to a torso of a patient;

a driving component configured to extend the mechanism toward the torso and retract the mechanism away from the torso; and a controller configured to control the driving component to:

determine a reference position by extending the mechanism to a first position in contact with the torso, extending the mechanism beyond the first position then retracting the mechanism to the first position, retracting the mechanism away from the first position until a threshold is exceeded, and then extending the mechanism to a point when the threshold is no longer exceeded and set the point as the reference position;

compress the torso by extending the mechanism from the reference position to a first distance and retracting the mechanism from the first distance to the reference position, and decompress the torso by retracting the mechanism from the reference position to a second distance and extending the mechanism from the second distance to the reference position.

2. The mechanical CPR device of claim 1, wherein the reference position corresponds to the natural resting position of the torso.

3. The mechanical CPR device of claim 2, wherein the threshold is a force threshold, the mechanical CPR device further comprising a spring activation sensor configured to output a signal when the mechanism has been retracted to exceed the threshold.

4. The mechanical CPR device of claim 3, wherein the spring activation sensor is further configured to stop outputting a signal when the mechanism has been extended to the point at which the threshold is no longer exceeded.

5. The mechanical CPR device of claim 1, wherein the threshold is a second threshold, and the controller is further configured to determine the reference position by controlling the driving component to:

extend the mechanism beyond the first position until a first threshold is reached.

6. The mechanical CPR device of claim 5, wherein the mechanism comprises a suction cup and the first threshold is a force threshold and the mechanical CPR device further comprising a force sensor configured to sense the force applied by the mechanism to cause air to be forced out from an area between the suction cup and the torso.

7. The mechanical CPR device of claim 5, wherein at least one of the first and second thresholds is a pressure threshold, the mechanical CPR device further comprising a pressure sensor configured to sense pressure in the area between the mechanism and the torso.

8. The mechanical CPR device of claim 5, wherein the controller is further configured to determine the reference position a predetermined number of times before controlling the driving component to compress the torso by extending the mechanism from the reference position to a first distance when the first threshold was exceeded and retracting the mechanism from the first distance to the reference position, and decompress the torso by retracting the mechanism from the reference position to a second distance when the second threshold was exceeded above the reference position.

9. The mechanical CPR device of claim 1, wherein the controller is further configured to determine the reference position in response to the mechanical CPR device receiving a user input.

10. The mechanical CPR device of claim 1, wherein the mechanism comprises a sticker plate.

11. A method for performing mechanical cardiopulmonary resuscitation (CPR), the method comprising:

attaching a mechanism to a torso of a patient;

determining a reference position by:

extending the mechanism to a first position in contact with the torso, extending the mechanism beyond the first position then retracting the mechanism to the first position, retracting the mechanism away from the first position until a threshold is exceeded, and then extending the mechanism to a point when the threshold is no longer exceeded and set the point as the reference position;

extending the mechanism from the reference position to a first distance below the reference position;

retracting the mechanism from the first distance to a second distance above the reference position; and extending the mechanism from the second distance to the reference position.

12. The method of claim 11, wherein the reference position corresponds to the natural resting position of the torso.

13. The method of claim 11, wherein the threshold is a second threshold, the method further comprising determining the reference position by:

extending the mechanism beyond the first position until a first threshold is reached.

14. The method of claim 13, wherein the first threshold is a force threshold.

15. The method of claim 13, wherein at least one of the first and second thresholds is a pressure threshold.

16. The method of claim 13, wherein at least one of the first and second thresholds is a distance threshold.

17. A mechanical CPR device, comprising:

a mechanism configured to attach a torso of a patient;

a driving component configured to extend the mechanism toward the torso and retract the mechanism away from the torso; and a controller configured to instruct the driving component to:

determine a reference position by extending the mechanism to a first position in contact with the torso, extending the mechanism beyond the first position then retracting the mechanism to the first position, retracting the mechanism away from the first position until a threshold is exceeded, and then extending the mechanism to a point when the threshold is no longer exceeded and set the point as the reference position, position the mechanism at the reference position when the mechanism is attached to the torso, retract the mechanism from the reference position to a second distance above a natural resting position of the torso, and extend the mechanism from the second distance above the natural resting position to the natural resting position.

18. The mechanical CPR device of claim 17, wherein the controller is further configured to instruct the driving component to:

extend the mechanism from the natural resting position to a first distance below the natural resting position; and retract the mechanism from the first distance below the natural resting position to the natural resting position.

19. The mechanical CPR device of claim 17, wherein the threshold is a second threshold and the controller is further configured to instruct the driving component to:

extend the mechanism beyond the first position to a first threshold point until a first threshold is reached.

20. The mechanical CPR device of claim 19, wherein the first threshold is a force threshold.

21. The mechanical CPR device of claim 19, wherein at least one of the first and second thresholds is a pressure threshold.

22. The mechanical CPR device of claim 19, wherein at least one of the first and second thresholds is a distance threshold.

23. The mechanical CPR device of claim 17, wherein the mechanism comprises a suction cup.

24. The mechanical CPR device of claim 17, wherein the mechanism comprises a sticker plate.

* * * * *